US011248760B2

(12) United States Patent
Sloan

(10) Patent No.: US 11,248,760 B2
(45) Date of Patent: Feb. 15, 2022

(54) MODULAR IN-GRADE FIXTURE WITH HEAT PIPES

(71) Applicant: B-K Lighting, Inc., Madera, CA (US)

(72) Inventor: Nathan Sloan, Madera, CA (US)

( * ) Notice: Subject to any disclaimer, the term of this patent is extended or adjusted under 35 U.S.C. 154(b) by 0 days.

(21) Appl. No.: 16/686,877

(22) Filed: Nov. 18, 2019

(65) Prior Publication Data

US 2020/0088366 A1 Mar. 19, 2020

Related U.S. Application Data

(63) Continuation of application No. 16/138,510, filed on Sep. 21, 2018, now Pat. No. 10,487,997, which is a continuation of application No. 15/145,174, filed on May 3, 2016, now Pat. No. 10,082,260.

(60) Provisional application No. 62/156,791, filed on May 4, 2015.

(51) Int. Cl.

| | |
|---|---|
| ***F21V 5/04*** | (2006.01) |
| ***F21S 8/02*** | (2006.01) |
| ***F21V 14/02*** | (2006.01) |
| ***F21V 29/73*** | (2015.01) |
| *F21V 23/02* | (2006.01) |
| *F21Y 115/10* | (2016.01) |
| *F21V 29/51* | (2015.01) |

(52) U.S. Cl.

CPC ..... *F21S 8/022* (2013.01); *F21V 5/04* (2013.01); *F21V 14/02* (2013.01); *F21V 29/73* (2015.01); *F21V 23/02* (2013.01); *F21V 29/51* (2015.01); *F21Y 2115/10* (2016.08)

(58) Field of Classification Search

CPC ..... F21S 8/022; F21V 29/73; F21V 29/51; F21V 14/02; F21V 5/04; F21V 23/02

See application file for complete search history.

(56) References Cited

U.S. PATENT DOCUMENTS

| | | | | |
|---|---|---|---|---|
| 10,323,829 | B1 * | 6/2019 | Zauhar | F21V 29/70 |
| 2011/0074265 | A1 * | 3/2011 | Van De Ven | F21S 8/02 313/46 |

* cited by examiner

*Primary Examiner* — Anne M Hines

(74) *Attorney, Agent, or Firm* — Ferguson Case Orr Paterson LLP

(57) ABSTRACT

The disclosure described herein is directed to an in-grade lighting fixture with improved heat dissipation that provides greater flexibility in servicing, replacing, or installing internal components within the fixture. The in-grade lighting fixture comprises features to assist in dissipating heat generated by light sources, such as LEDs, and/or other electronic components to optimize performance and allow for increased output power for the light sources. The disclosure uses a heat sink assembly that is in thermal communication with the in-grade lighting fixture in order to dissipate heat within the lighting fixture out to the ambient, which optimizes performance and allows for increased output power for the light source.

1 Claim, 5 Drawing Sheets

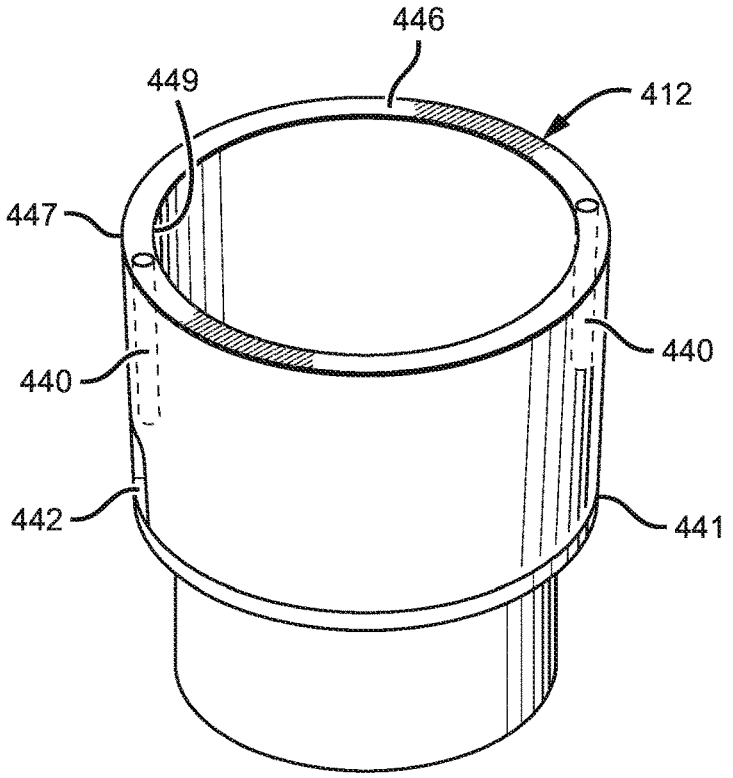
FIG. 5
FIG. 6
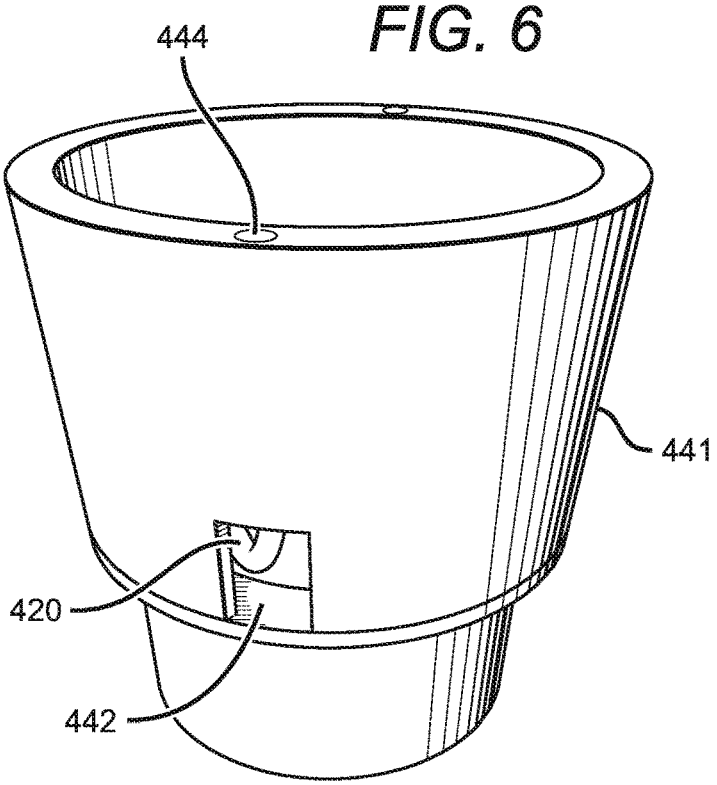

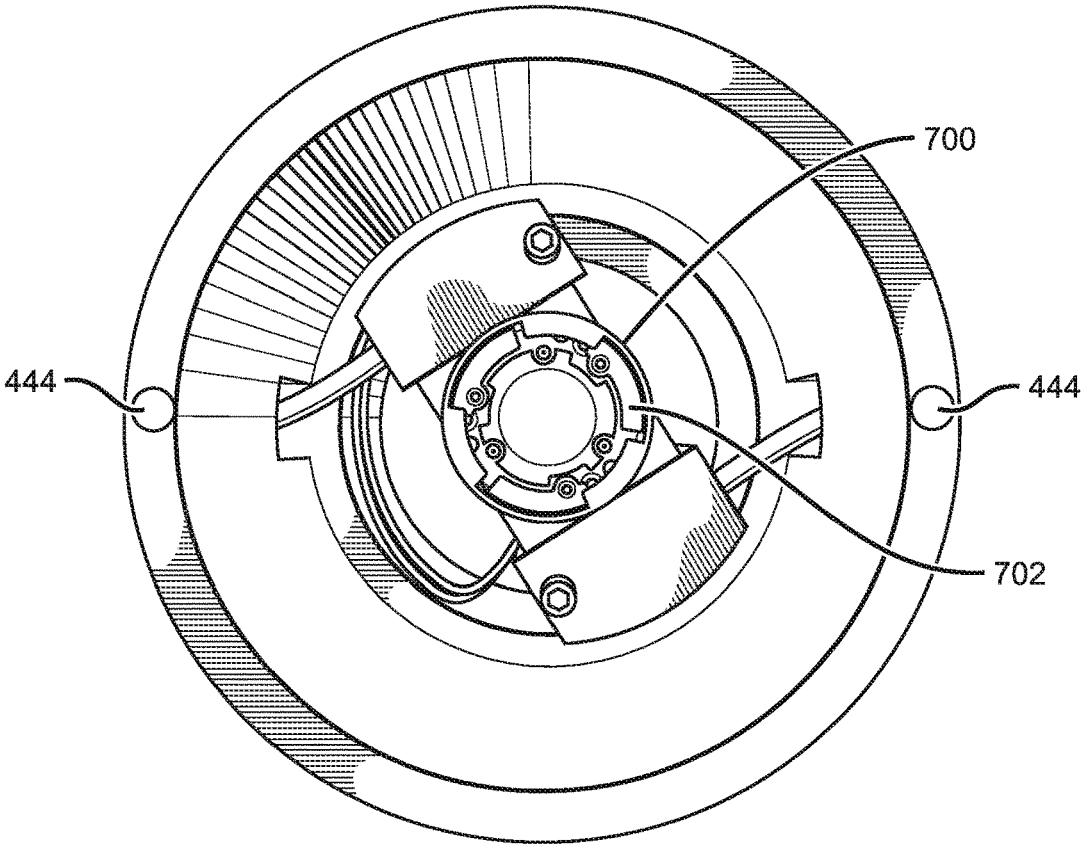
FIG. 7
FIG. 8
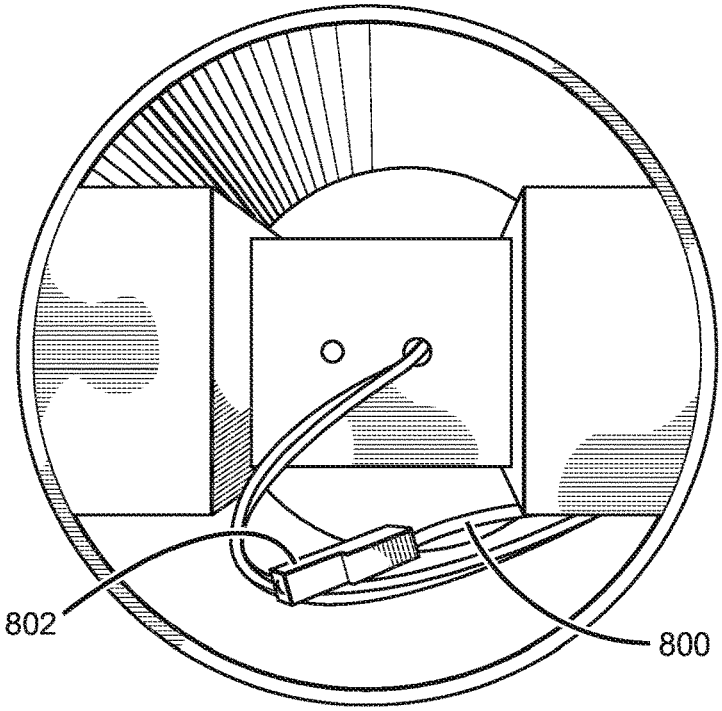

MODULAR IN-GRADE FIXTURE WITH HEAT PIPES

RELATED APPLICATION

This application is a continuation of and claims the benefit of U.S. patent application Ser. No. 16/138,510 (now U.S. Pat. No. 10,487,997), filed on Sep. 21, 2018, which is a continuation of and claims the benefit of U.S. patent application Ser. No. 15/145,174, filed on May 3, 2016 (now U.S. Pat. No. 10,082,260), which claims the benefit of U.S. Provisional Application Ser. No. 62/156,791 to Nathan Sloan, filed on May 4, 2015. Each of the above-referenced applications, including its drawings, schematics, diagrams, and written description, is hereby incorporated by reference in its entirety.

BACKGROUND

Field

This disclosure generally relates to lighting fixtures using a passive cooling technology and more particular to a modular in-grade luminaire with heat pipes.

Description of the Related Art

Conventional in-ground or in-grade lighting fixtures are typically buried all or partially below ground level and include a light emitter that illuminates up from below ground level. They can be buried in the earth or covered by hardscape such as concrete, asphalt, wood, pavers, tile, etc. The fixtures are typically used to illuminate walls, columns, flags, trees, signs or a pathway.

One type of in-grade lighting fixture generally comprises a housing and lens made of glass or other rigid and transparent material that is attached to an opening in the top of a housing. The housing contains various components including the light emitter that is arranged to emit light through the lens and electrical components that are used to power and operate the light emitter. When the light fixture is installed in-grade, the housing is typically below ground level and the lens is left uncovered so light can shine up through it. The electrical components can include a power supply, power converters, transformers, and mounting hardware for the light emitter. To hold all of these components, the housing can extend relatively deep into the ground (i.e. 14 to 16 inches).

During installation of these types of light fixtures, a hole is typically dug for the housing, the housing is placed in the hole and the hole is back filled around the housing. Any hardscape is then installed around the lens, leaving the lens uncovered.

In-grade light fixtures can have an optical chamber that contains the light emitter (lamp), with the optical chamber arranged in the housing so that light from the lamp emits through an upper housing opening. One disadvantage of conventional optical chambers is that condensation can develop inside the chamber through the heating and cooling of the lamp. These types of fixtures also have ballasts that contain electronic components such as transformers and capacitors. These ballasts can also develop condensation during heating and cooling that can cause failure or reduced life of the components.

With the advent of the efficient solid state lighting sources, it is more common for light emitting diodes (LEDs) to be used as the light source in lighting applications. LEDs have certain characteristics that make them desirable for many lighting applications that were previously the realm of incandescent or fluorescent lights. Incandescent lights are very energy-inefficient light sources with a vast majority of the electricity they consume being released as heat rather than light. Fluorescent light bulbs are more energy efficient than incandescent light bulbs, but are still relatively inefficient. LEDs by contrast, can emit the same luminous flux as incandescent and fluorescent lights using a fraction of the energy.

Modern lighting applications often demand high power LEDs while reducing the size of the LED package. High power LEDs can draw large currents, generating significant amounts of heat that must be managed. There can be issues in using high power LEDs as a light source for in-grade light fixtures. In-grade light fixtures typically enclose the light source from exposure to the surrounding environment, such as water or soil, which could damage the light source and/or other electronic components within the in-grade light fixture. In-grade light fixtures retain heat generated from the light source and/or other electronic components and can have difficulty in dissipating the heat to the earth or surrounding hardscape. This results in power output limitations for the LEDs of approximately 15 W in order to maximize the light emitted by the LEDs.

The most common problems resulting from the operational temperature of the in-grade light fixture becoming too hot include reduced light emission from the LEDs and failure or reduced life of the LEDs and/or other electronic components.

Conventional in-grade light fixtures are typically installed in settings where replacement of an in-grade light fixture is labor intensive and could require demolition. In other conventional light fixtures one or more ballasts can be included inside the housing, which can increase the overall size of the light fixture. Conventional light fixtures also do not provide flexibility in the placement of ballasts or other internal components to allow the light fixture to be configured to meet space constraints during installation. It is desirable to not have to remove and replace the entire in-grade light fixture with an updated in-grade light fixture, and instead install updated electronic components within existing in-grade light fixtures. As such, the internal spacing of the installed in-grade light fixture is limited and any new or updated cooling devices that are installed to assist with heat dissipation must be configured to meet the space constraints of previously installed in-grade light fixtures.

SUMMARY

The disclosure provides various aspects of an in-grade lighting fixture with improved heat dissipation. The disclosure provides an in-grade lighting fixture with improved heat dissipation that provides greater flexibility in servicing, replacing, or installing internal components within the fixture. The in-grade lighting fixture comprises features to assist in dissipating heat generated by light sources, such as LEDs, and/or other electronic components to optimize performance and allow for increased output power for the light sources.

In one aspect of the disclosure, as broadly described herein, an in-grade lighting fixture is disclosed with improved heat dissipation, comprising a fixture housing comprising an optical chamber in an upper portion of the fixture housing, and electronic components in a lower portion of the fixture housing. The optical chamber comprises a light source and a heat sink assembly, wherein the light source emits light out a top opening of the upper portion of the housing when power is applied to the light source. The heat sink assembly is within the upper portion of the fixture housing and is in thermal communication with at least the upper portion of the fixture housing.

In another aspect of the disclosure, as broadly described herein, an in-grade lighting fixture is disclosed with a passive cooling system, comprising a fixture housing comprising an upper portion and a lower portion, a heat sink assembly in thermal communication with the fixture housing, wherein the fixture housing is thermally conductive such that the heat sink assembly transfers heat flux through the fixture housing into the ambient.

This has outlined, rather broadly, the features and technical advantages of the disclosure in order that the detailed description that follows may be better understood. Additional features and advantages of the disclosure will be described below. It should be appreciated by those skilled in the art that this disclosure may be readily utilized as a basis for modifying or designing other structures for carrying out the same purposes of the present disclosure. It should also be realized by those skilled in the art that such equivalent constructions do not depart from the teachings of the disclosure as set forth in the appended claims. The novel features, which are believed to be characteristic of the disclosure, both as to its organization and method of operation, together with further objects and advantages, will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE DRAWINGS

FIG. 5 is a perspective view of a heat sink assembly according to an aspect of the disclosure.

FIG. 6 is another perspective view of a heat sink assembly according to an aspect of the disclosure.

FIG. 7 is a top view of the heat sink assembly of FIG. 6.

FIG. 8 is a bottom view of the heat sink assembly of FIG. 6.

DETAILED DESCRIPTION

Figure 1:
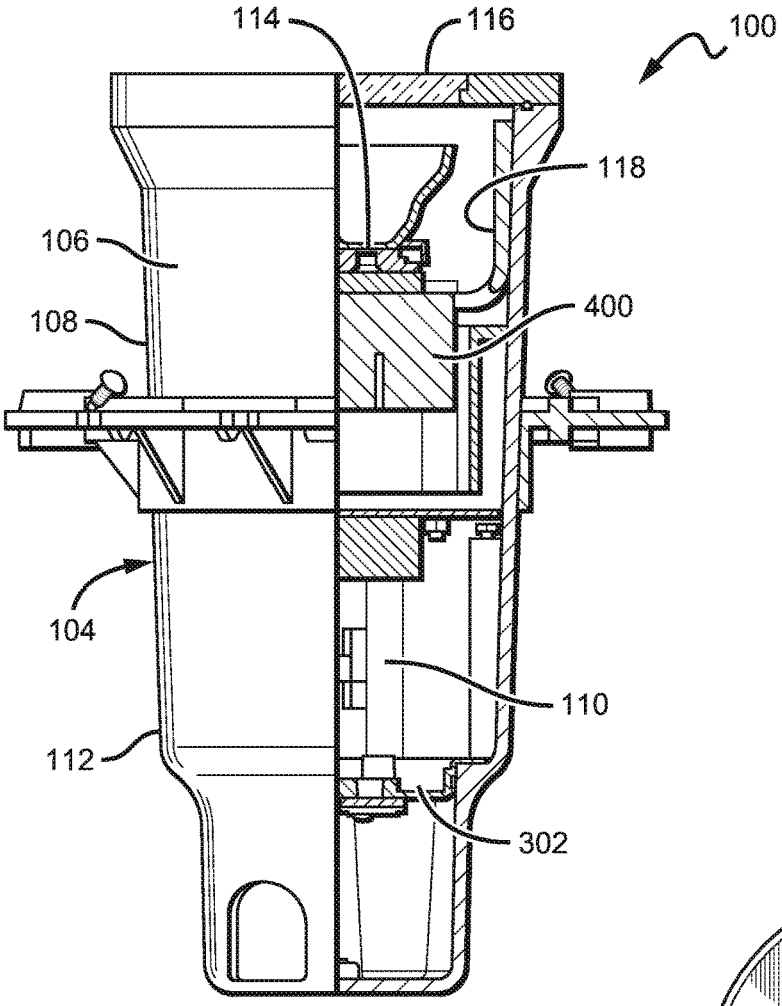
FIG. 1 is a perspective view of an in-grade lighting fixture according to an aspect of the disclosure.

The disclosure described herein is directed to different aspects of an in-grade lighting fixture with improved heat dissipation. The detailed description set forth below, in connection with the appended drawings, is intended as a description of various configurations and is not intended to represent the only configurations in which the concepts described herein may be practiced. The detailed description includes specific details for the purpose of providing a thorough understanding of the various concepts. It will be apparent, however, to those skilled in the art that these concepts may be practiced without these specific details. In some instances, well-known structures and components are shown in block diagram form in order to avoid obscuring such concepts. As described herein, the use of the term "and/or" is intended to represent an "inclusive OR", and the use of the term "or" is intended to represent an "exclusive OR".

The disclosure uses a heat sink assembly that is in thermal communication with the in-grade lighting fixture in order to dissipate heat within the lighting fixture out to the ambient. The heat sink assembly is configured to receive a light source, such that the light source emits light out of the lighting fixture in response to a bias. The heat sink assembly can also be configured to allow for the light emission of the light source to be adjusted and/or modified from within the in-grade lighting fixture without having to remove the lighting fixture. The in-grade lighting fixture provides greater flexibility in servicing, replacing, and/or installing internal components within the fixture. As further described below, the fixture 100 has features to assist in dissipating heat generated by the light source, such as but not limited to LEDs, to optimize performance and allow for increased output power for the light source.

The disclosure is described herein with reference to certain aspects, but it is understood that the disclosure can be embodied in many different forms and should not be construed as limited to the aspects set forth herein. In particular, the disclosure is described herein in regards to an in-grade lighting fixture with improved heat dissipation, but it is understood that the disclosure can be utilized in many different types of lighting fixtures and is not limited to in-grade lighting fixtures.

Although the terms first, second, etc. may be used herein to describe various elements or components, these elements or components should not be limited by these terms. These terms are only used to distinguish one element or component from another. Thus, a first element discussed herein could be termed a second element without departing from the teachings of the present application. It is understood that actual systems or fixtures embodying the disclosure can be arranged in many different ways with many more features and elements beyond what is shown in the figures.

It is to be understood that when an element or component is referred to as being "on" another element or component, it can be directly on the other element or intervening elements may also be present. Furthermore, relative terms such as "between", "within", "below", and similar terms, may be used herein to describe a relationship of one element or component to another. It is understood that these terms are intended to encompass different orientations of the disclosure in addition to the orientation depicted in the figures.

Aspects of the disclosure are described herein with reference to illustrations that are schematic illustrations. As such, the actual thickness of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region of a device and are not intended to limit the scope of the disclosure.

FIG. 1 shows one aspect of an in-grade lighting fixture 100 according to the disclosure.

The in-grade lighting fixture 100 comprises a generally cylindrical fixture housing 104 comprising an optical chamber 106 in an upper portion 108 of the housing, and electronic components 110 in a lower portion 112 of the housing. The optical chamber 106 comprises a light source 114 and a heat sink assembly 400. The light source 114 is mounted on the heat sink assembly 400 and emits light out a top opening 116 of the upper portion 108 of the housing 104 when power is applied to the light source 114. In one aspect, the light source 114 can be comprised of at least one LED. However, in other aspects, the light source 114 can comprise many different types of light sources, such as but not limited to lasers, fluorescent lights, etc., each of which can be arranged in many different ways within the optical chamber 106. The heat sink assembly 400 is disposed within the upper portion 108 of the housing 104, such that the heat sink assembly 400 is in thermal communication with at least the upper portion 108 of the housing 104.

Figure 2:
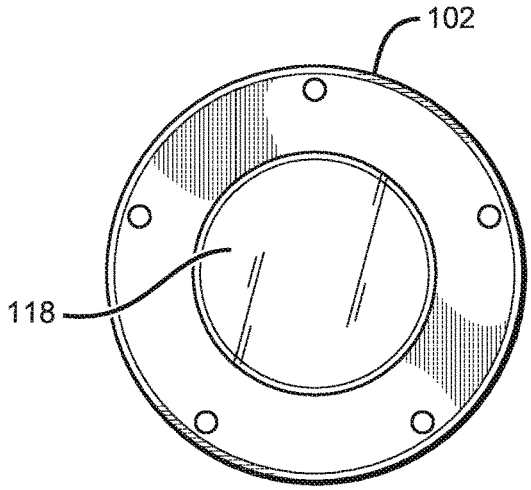
FIG. 2 is a top view of the in-grade lighting fixture of FIG. 1.

With reference to FIG. 2, the fixture further comprises a faceplate 102 that is mounted in place over the top opening 116 of the upper portion 108 of the housing 104. The faceplate 102 can comprise a lens 118 that allows emitted light to pass substantially unaltered, while in other aspects, the faceplate 102 can comprise optical elements that are configured to alter and/or direct light emitted from the light source 114. In some aspects, the optical elements can comprise light altering features to modify and/or alter the light emission of the light source. For example, the optical element can comprise refractive properties that spread or widen the emission pattern of the light source, while in other aspects, the optical element can comprise beam collimating features that concentrate the emission of the light source such that the emission pattern of the light source is narrowed. In some aspects, the optical elements can comprise wavelength conversion features that are configured to change the color of at least some of the light emitted from the light source. At least one advantage of the disclosure is that the faceplate 102 can be customized to accommodate various lighting applications. The faceplate 102 is configured to be substantially flush with the surrounding grading or surface that the in-grade lighting fixture 100 is installed. The faceplate 102 is shock resistant and is suitable for walk-over and/or drive-over applications, such as but not limited to pedestrian pathways, streets, vehicle pathways, and the like.

Figure 3:
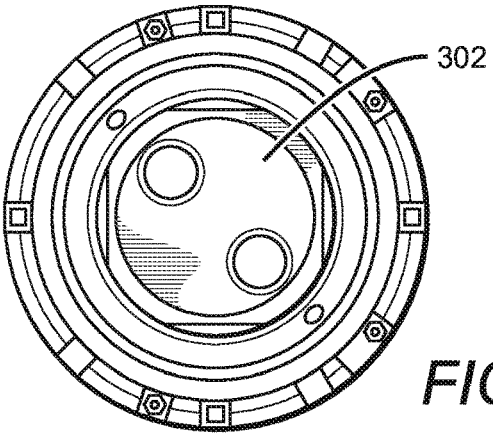
FIG. 3 is a bottom view of the in-grade lighting fixture of FIG. 1.

When the optical chamber 106 is installed within the fixture 100 and the faceplate 102 is mounted over the top opening 116 of the upper portion 108 of the housing 104, a seal is created between the faceplate 102 and the upper portion 108 of the housing 104 such that the optical chamber 106 is sealed from the ambient. The fixture 100 is further configured to allow air within the housing 104 to pass out of the optical chamber 106 when pressure builds up in the chamber 106, and to block ambient air from returning into the optical chamber 106. The fixture 100 can comprise a valve 302, as shown in FIG. 3, which allows air within the housing 104 to exit and prevent air from returning. In some aspects, the valve 302 can be a component of the upper portion of the housing, the optical chamber, the lower portion of the housing or a combination thereof.

During operation of the fixture 100, air within the upper and lower portions 108, 112 of the fixture housing 104 can be heated, which causes the air to expand and increases the air pressure within the upper and lower portions 108, 112 of the fixture housing 104. The valve 302 allows air to exit as the air pressure increases. When the fixture 100 is not in operation, air within the upper and lower portions 108, 112 of the housing 104 cools, but air is prevented from entering the fixture housing 104 due to the valve 302. This results in the formation of a negative air pressure, or vacuum, within the upper and lower portions 108, 112 of the fixture housing 104, and prevents condensation within the optical chamber 106, upper portion 108 and/or lower portion 112. The fixture 100 can have one or more valves 302 within the optical chamber 106, upper portion 108 and/or lower portion 112 of the fixture housing 104 that operate in conjunction with or independent from each other. The faceplate 102 is removably coupled to the upper portion 108 of the fixture housing 104. The faceplate 102 being removable allows the optical chamber 106 to be easily accessible. Removal of the faceplate 102 breaks the seal between the faceplate and the fixture housing 104 and allows air to enter into the fixture 100. However, once the newly entered air becomes heated and the air pressure within the fixture housing 104 increases, the air that entered due to the removal of the faceplate 102 exits out the fixture 100 through the valve 302. The negative air pressure, or vacuum, within the fixture 100 is thereby restored.

The electronic components 110, such as but not limited to a ballast, can be housed within the lower portion 112 of the housing 104. The electronic components 110 are configured to provide sufficient voltage to the light source 114 and regulate the current provided to the light source 114. Power is supplied to the electronic components 110 from an external power source and the power for operating the light source 114 and electronic components 110 is typically provided by wiring contained in an outer protective conduit line that attaches to the lower portion 112 of the housing 104, which is known in the art. The electronic components 110 provide a wiring compartment, which is accessible from within the fixture 100, for wiring the light fixture to the external power source. The electronic components 110 provide electrical conductors that couple to the light source 114 within the upper portion 108, in order to provide power to the light source 114.

Figure 4:
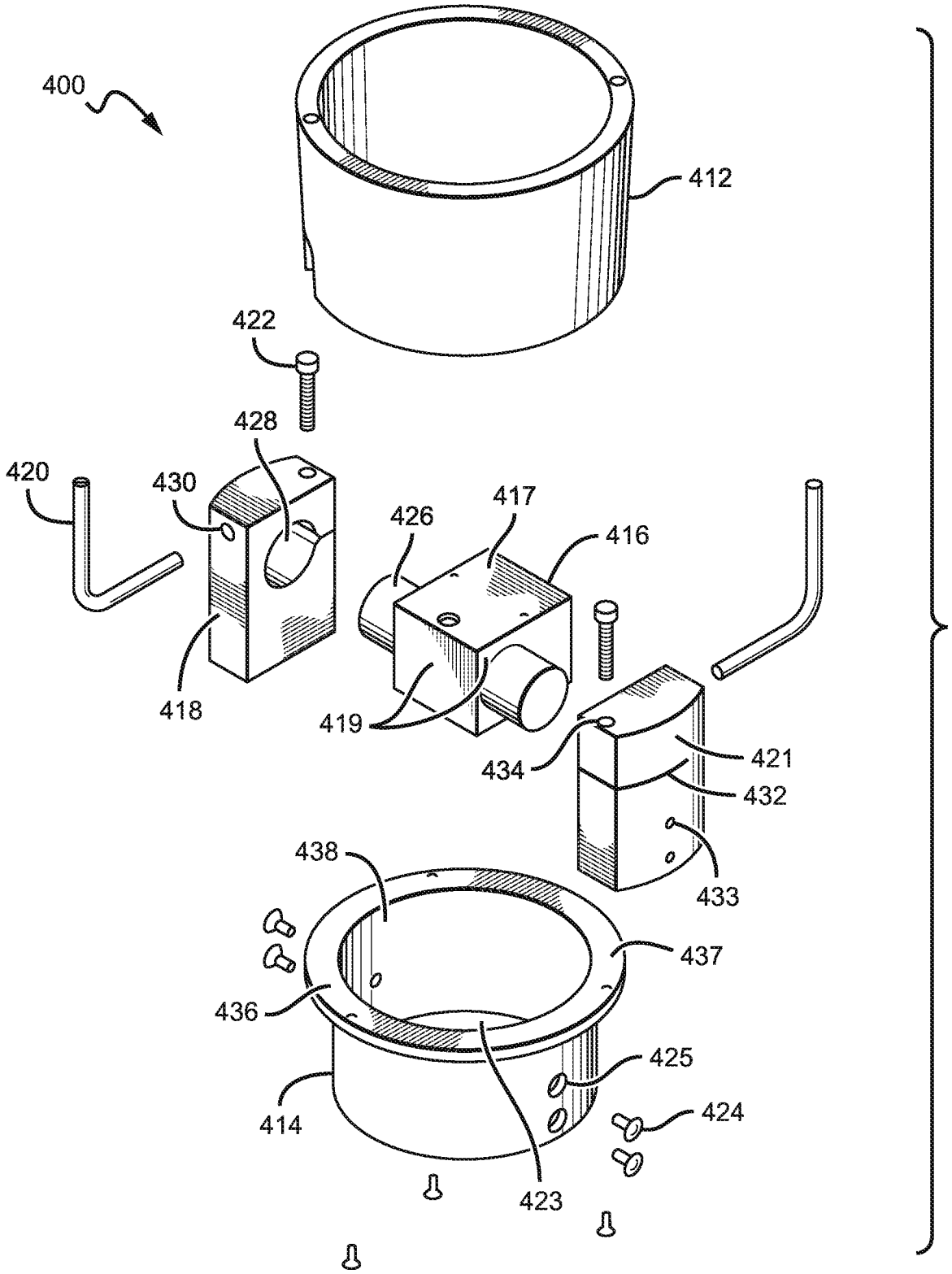
FIG. 4 is an exploded view of a heat sink assembly according to an aspect of the disclosure.

FIG. 4 shows one aspect of a heat sink assembly 400 according to the disclosure.

In one aspect of the disclosure, the heat sink assembly 400 is a passive cooling system that is configured to dissipate heat within the fixture housing 104 to the ambient. In one aspect, the heat sink assembly 400 is disposed within the upper portion 108 of the fixture housing 104 and is in thermal communication with at least one inner surface of the upper portion 108 of the fixture housing 104. The heat sink assembly 400 transfers heat flux generated by the light source 114 away from the light source 114 and into a cooler condensing unit of the heat sink assembly 400. The heat flux is thereby transferred from the heat sink assembly 400 to the upper portion 108 of the fixture housing 104 and is dissipated to the ambient. The heat sink assembly 400 dissipates heat from the light source 114 such that the operational temperature of the light source 114 and/or the temperature within the fixture housing 104 does not exceed the temperature threshold for the light source 114 used. The temperature threshold is determined by the manufacturer of the light source 114 and in some aspects can range from 90° C. to 105° C., for example, while other light sources 114 can have a temperature threshold range that is lesser or greater.

In some aspects, the heat sink assembly 400 can comprise one or more LEDs mounted on a heat sink 416 and one or more heat pipes 420, wherein the one or more heat pipes 420 are in thermal communication with the heat sink 416 and the fixture housing 104, such that heat generated from the LEDs is dissipated to the ambient. The upper portion 108 and lower portion 112 of the fixture housing 104 can be comprised of thermally conductive materials such that the fixture housing 104 assists in the dissipation of heat. This arrangement allows for the LEDs to operate at a lower temperature. In addition, a thermally conductive housing 104 could eliminate the need of an active cooling system, thereby reducing manufacturing costs. The heat sink assembly 400 being in thermal communication with the fixture housing 104 allows the one or more LEDs to be driven at an increased output power to produce a higher luminous flux while maintaining the operational temperature of the LEDs below the temperature threshold.

Heat pipes are generally known in the art and are only briefly discussed herein. Heat pipes can comprise a heat-transfer device that combines the principles of both thermal conductivity and phase transition to efficiently manage the transfer of heat between two interfaces. At the hot interface within a heat pipe, a liquid in contact with a thermally conductive solid surface turns into a vapor by absorbing heat from that surface. The vapor condenses back into a liquid at the cold interface, releasing the latent heat. The liquid then returns to the hot interface through either capillary action or gravity action where it evaporates once more and repeats the cycle. In addition, the internal pressure of the heat pipe can be set or adjusted to facilitate the phase change depending on the demands of the working conditions of the thermally managed system.

A typical heat pipe is comprised of a sealed pipe or tube made of a material with high thermal conductivity, such as copper or aluminum at least at both the hot and cold ends. A vacuum pump can be used to remove air from the empty heat pipe, and the pipe can then be filled with a volume of working fluid (or coolant) chosen to match the operating temperature. Examples of such fluids include water, ethanol, acetone, sodium, or mercury. Due to the partial vacuum that can be near or below the vapor pressure of the fluid, some of the fluid can be in the liquid phase and some will be in the gas phase.

The heat sink assembly 400 comprises an upper body 412, a lower body 414, a heat sink 416, at least one clamp 418, and at least one heat pipe 420, wherein the at least one heat pipe 420 is in thermal communication with the heat sink and the upper body.

The heat sink 416 comprises a top mount surface 417, a bottom surface (not shown), and a plurality of side surfaces 419, wherein the side surfaces 419 are interposed between the top mount surface 417 and the bottom surface. The top mount surface 417 of the heat sink 416 is configured to receive a light source, and at least one heat sink extension 426 extends from at least one of said plurality of side surfaces 419. In the aspect of the heat sink 416 shown in FIG. 4, the heat sink 416 is shown as having a cube-like shape, but the disclosure is not intended to be limited to the heat sink 416 having a cube-like shape. In other aspects, the heat sink 416 can be in the form of many different shapes, such as but not limited to, cuboid, pyramid, spherical, cylindrical, and the like, and/or a combination thereof.

The at least one clamp 418 comprises a clamp opening 428, a heat pipe opening 430, a clamp slot 432, and a clamp screw opening 434. The clamp opening 428 receives the at least one heat sink extension 426 in order to thermally couple the heat sink 416 and the clamp 418. The clamp 418 is comprised of thermally conductive materials and assists in dissipating heat from the heat sink 416. In the aspect of FIG. 4, the heat sink extension 426 comprises a cylindrical shape and the clamp opening 428 is correspondingly shaped to the heat sink extension 426. However, in other aspects, the heat sink extension can be arranged in many different shapes and is not intended to be limited to a cylindrical shape. Additionally, the clamp opening can be arranged in many different shapes and is not intended to be limited to be correspondingly shaped to the heat sink extension.

The clamp slot 432 is a narrow opening that extends through part of the clamp opening 428. The clamp slot 432 allows the clamp 418 to partially increase the size of the clamp opening 428 in order to receive the heat sink extension 426. Partially increasing the size of the clamp opening 428 allows the heat sink extension 426 to be easily received by the clamp opening 428, especially in instances where the clamp opening 428 and heat sink extension 426 have substantially similar dimensions. The clamp screw opening 434 extends into the clamp 418 from an upper surface of the clamp 418 to a distance beyond the clamp slot 432. A clamp screw 422 can be threadedly received by the clamp screw opening 434 such that the clamp screw 422 pulls the portions of the clamp below and above the clamp slot 432 together as the clamp screw is threaded into the clamp screw opening, thereby tightening the clamp opening 428 around the heat sink extension 426. This firmly couples the clamp 418 and heat sink 416 together, and also forms a thermal path between the heat sink 416 and the clamp 418.

The clamp 418 is further configured to receive the heat pipe 420. The clamp 418 comprises a heat pipe opening 430 that receives the heat pipe 420 in order to form a thermal connection between the heat pipe 420 and the heat sink 416. The heat pipe opening 430 is an aperture that extends into the clamp 418 and allows at least part of the heat pipe 420 to be inserted into the heat pipe opening 430 to thermally couple the heat pipe 420 and the clamp 418. In some aspects, the heat pipe opening 430 can be correspondingly shaped to the heat pipe 420, but in other aspects, the heat pipe opening 430 can have a different shape than the heat pipe 420. The heat pipe 420 can be bonded to the clamp 418 by using thermal epoxy or the like, such that at least part of the heat pipe 420 is bonded to the clamp 418 within the heat pipe opening 430. The thermal epoxy can also form a seal between the heat pipe 420 and the heat pipe opening 430.

The upper body 412 is configured to be thermally coupled to the heat pipe 420, such that the upper body 412 is in thermal communication with the heat sink 416. In one aspect, as shown in FIG. 5, the upper body 412 comprises a cylindrical body 441, at least one window 442 and at least one channel 440, wherein part of the heat pipe 420 is received within the at least one channel 440. The at least one channel 440 is adjacent to a corresponding at least one window 442, and extends from the at least one window 442 to a top surface 446 of the upper body 412. The at least one channel 440 is between an outer wall 447 and an interior wall 449 of the cylindrical body 441, such that the heat pipe 420 within the at least one channel 440 is enclosed within the cylindrical body 441. The at least one window 442 is a cut-out portion of the cylindrical body 441 that allows the heat pipe 420 to be received within the at least one channel 440.

As shown in FIGS. 4, 6 and 7, the heat pipe 420 comprises a substantially horizontal portion coupled to the clamp 418 and a substantially vertical portion that is coupled to the upper body 412. The heat pipe 420 further comprises a bent portion between the substantially horizontal and vertical portions, wherein the at least one window 442 of the upper body 412 accommodates for the transition between the substantially horizontal and vertical portions. The at least one window 442 allows the bent portion of the heat pipe 420 to have a bend radius within the design specifications of the heat pipe, such that the bend radius does not exceed the designed specifications. A bend radius that exceeds the designed specifications can cause damage to the heat pipe, which could negatively affect the thermal conductivity of the heat pipe and/or result in heat pipe failure. The window 442 of the upper body 412 allows the heat pipe 420 to be bent so that the heat pipe can be received by the upper body 412, in order to thermally couple the heat pipe and the upper body.

The at least one channel 440 extends from the corresponding window 442 into the cylindrical body 441 of the upper body 412 and allows part of the heat pipe 420 to be inserted into the at least one channel 440. In some aspects, the at least one channel 440 can be correspondingly shaped to the heat pipe 420. However, in other aspects, the at least one channel can have a shape that is different than the heat pipe. The heat pipe 420 can be bonded to the upper body 412 by using thermal epoxy or the like, wherein the thermal epoxy bonds the heat pipe to the at least one channel 440. The thermal epoxy also seals the heat pipe 420 within the upper body 412. The at least one channel 440 can be arranged in many different configurations. In some aspects, the at least one channel 440 partially extends into the upper body 412 from the window 442. In other aspects, the at least one channel 440 extends into the upper body 412 from the window 442 to an upper surface 446 of the upper body 412 opposite the window 442. In such aspects, as shown in FIGS. 5, 6 and 7, the channel 440 can be filled with the thermal epoxy such that the heat pipe 420 is bonded to the upper body and a seal 444 is formed at the upper surface 446. The seal 444 protects the heat pipe 420 within the channel 440 from external environmental elements that could cause damage to the heat pipe 420.

With reference to FIG. 4, the heat sink 416 and the at least one clamp 418 are configured to be received by the lower body 414 of the heat sink assembly 400. In one aspect, the lower body 414 is cylindrically shaped and comprises a ridge 436 on a top surface 437 and an opening 423 to receive the heat sink 416 and the at least one clamp 418. The at least one clamp 418 is coupled to an inner surface 438 of the lower body 414. In one aspect, the at least one clamp 418 comprises a surface 421 opposite the heat sink 416 and is correspondingly shaped to the inner surface 438 of the lower body 414. However, in other aspects, the surface 421 of the clamp 418 and/or the inner surface 438 of the lower body 414 can be shaped differently and do not have to be correspondingly shaped. The clamp and/or the inner surface 438 can be arranged in many different shapes and the disclosure is not intended to be limited to the aspects disclosed herein. The lower body 414 comprises at least one lower screw hole 425 and the at least one clamp 418 comprises a corresponding at least one clamp screw hole 433 that is arranged to be aligned with the at least one lower screw hole 425 of the lower body 414. A lower body screw 424 is received by each of the aligned lower screw hole 425 of the lower body 414 and the clamp screw hole 433 of the clamp 418 in order to couple the clamp 418 to the inner surface 438 of the lower body 414. A thermal connection is thereby formed between the clamp 418 and the lower body 414.

In the aspect of FIG. 4, the heat sink 416 comprises two heat sink extensions 426, two clamps 418, and two heat pipes 420. However, the heat sink can be configured in many different ways having different number of heat sink extensions, clamps, and/or heat pipes, and is not intended to be limited to the aspects of the disclosure. The heat sink 416 comprises a first heat sink extension 426 and a second heat sink extension 426 on opposite surfaces 419, wherein the first and second heat sink extensions 426 are axially aligned and coupled to a respective first and second clamp 418. The first and second heat sink extensions 426 are received within a respective clamp opening 428 of the respective first and second clamps 418. First and second heat pipes 420 are coupled to a respective first and second clamp 418 and a respective first and second channel 440 of the upper body 412, similarly as discussed above. The first and second clamps 418 are coupled to the lower body 414, as discussed above, wherein the first clamp is opposite the second clamp 418.

At least one advantage of the disclosure, is that the heat sink 416 can pivot about the first and second heat sink extensions 426 to adjust the light emission of the light source mounted on the heat sink 416. The respective clamp screws 422 of the first and second clamps 418 can be partially unthreaded from each of the clamp screw opening 434 thereby loosening the connection of each clamp opening 428 around the first and second heat sink extensions 426. The heat sink 416 can then be rotated about the first and second heat sink extensions 426 to a desired angle. After the heat sink 416 has been adjusted to the desired angle, the clamp screws 422 of the first and second clamps 418 can be threaded to tighten the respective clamp openings 428 around the first and second heat sink extensions 426. Pivoting the heat sink about the heat sink extensions allows the light source to be adjusted after the fixture 100 has been installed without having to demolish the surrounding hardscape and uninstall the entire in-grade lighting fixture. Yet another advantage of the disclosure is that pivoting the heat sink can also compensate for fixtures that were not properly installed and/or have shifted over time. The heat sink being pivotable about the heat sink extensions is not limited to the aspect of FIG. 4. In other aspects of the disclosure wherein the heat sink comprises one or more heat sink extensions, the heat sink can also be arranged to allow the heat sink to pivot about the one or more heat sink extensions, as discussed herein.

With reference to FIGS. 4-8, the upper body 412 and lower body 414 are configured to be coupled to each other. The upper body 412 is disposed on the ridge 436 of the lower body 414. The ridge 436 of the lower body and the lower surface of the upper body 412 comprise aligned openings (not shown) that allow a screw or the like to be received by the aligned openings in order to couple the upper and lower bodies together. The upper and lower bodies can be comprised of thermally conductive materials, known in the art. The coupled upper and lower bodies form the thermal path that is used to transfer heat from the heat sink 416 to the upper and/or lower bodies 412, 414 of the heat sink assembly 400, to the fixture housing 100 and out to the ambient. The heat sink assembly 400 is installed in the upper portion 108 of the fixture housing 100, and when installed, the upper body 412 of the heat sink assembly 400 substantially contacts the inner surface 438 of the upper portion 108 of the fixture housing 100. The heat sink assembly 400 transfers heat from the heat sink 416 to at least the upper body 412, which is in contact with the inner surface 438 of the fixture housing 100. This thermal path dissipates the heat to the soil, and can also dissipate heat to the faceplate. In other aspects, both the upper body 412 and the lower body 414 can substantially contact the inner surface 438 of the upper portion 108 of the fixture housing 104, further enhancing the thermal dissipation. The heat sink assembly 400 can be mounted to the upper portion 108 of the fixture housing 100, while in other aspects, the heat sink assembly 400 rests on a surface and/or extension within the upper portion 108 of the fixture housing 100.

An advantage of the disclosure is that the heat sink assembly 400 is arranged to allow for 360° rotation of the heat sink assembly 400 within the upper portion 108 of the fixture housing 100, thereby allowing the optical orientation to be set to a desired orientation. Rotating the heat sink assembly 400 within the fixture housing also allows for further customization of the light emission of the light source. When the light source is mounted on the heat sink 416 and is operating, the heat sink assembly 400 utilizes the heat pipes 420 that accelerate the heat transfer away from the light source with pure conduction to the exterior of the fixture housing 100 without compromising lumen output. The heat sink assembly 400 ensures longer extended lifetime performance of the light source. The disclosure provides heat dissipation through the heat pipes and through the fixture housing to the ambient. Yet another advantage of the disclosure is that the heat sink assembly 400 is easily removable from the fixture 100, such that the light source, driver and/or other electronic components within the fixture 100 can be easily accessed, serviced and/or replaced.

In one aspect, as shown in FIG. 7, the light source comprises an LED package 700 mounted on the heat sink 416. The LED package 700 can comprise one or more LEDs that emit light in response to a bias. The LED package 700 further comprises an adapter ring having reflector slots 702, wherein a reflector can be received by the reflector slots in order to attach the reflector to the LED package. The reflector slots allow different reflectors, having various beam shaping characteristics, to be used with the LED package 700 in order to customize the light emission from the fixture 100 to accommodate various lighting applications. FIG. 8 shows a bottom view of the heat sink assembly 400, wherein conductors 800 are electrically connected to the LED package 700 and are configured to be connected to an external power source. The conductors 800 comprise a connector 802 that can be coupled to the external power source or other electronic components. At least one advantage of the disclosure is that the light source or LED package 700 can be easily removed from the heat sink assembly 400 and replaced with a new light source or LED package.

Figure 9:
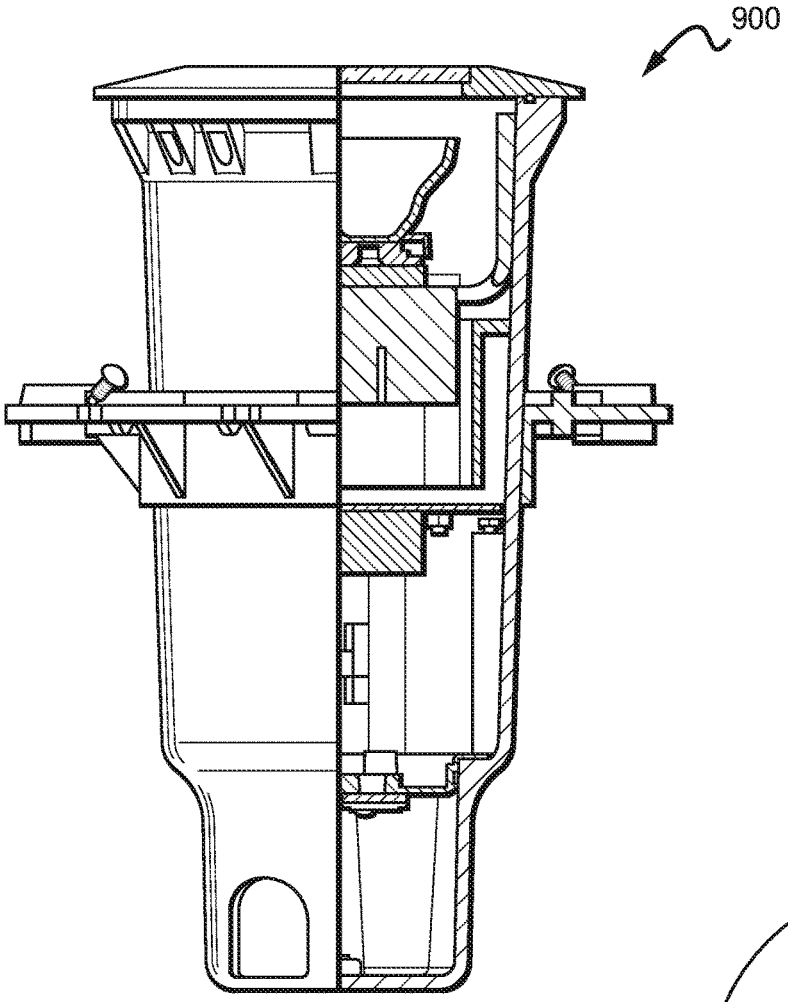
FIG. 9 is a perspective view of an in-grade lighting fixture according to an aspect of the disclosure.
Figure 10:
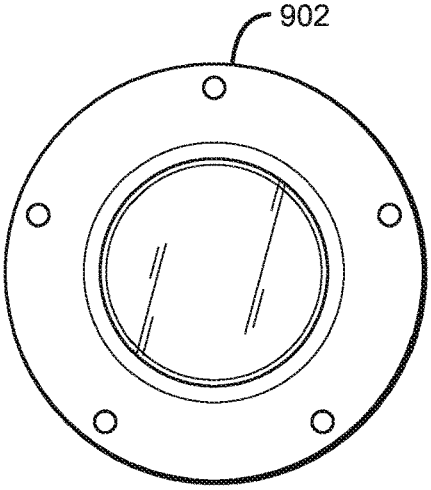
FIG. 10 is a top view of the in-grade lighting fixture of FIG. 9.
Figure 11:
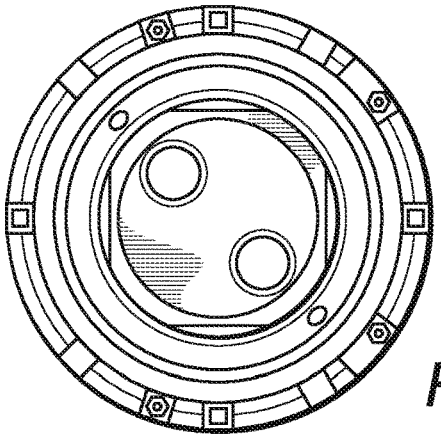
FIG. 11 is a bottom view of the in-grade lighting fixture of FIG. 9.

FIGS. 9-11 shows another aspect of the disclosure, wherein the heat sink assembly 400 is installed in a light fixture 900, wherein the faceplate 902 is a flange. The faceplate 902 comprises a beveled surface and an optical element, similar to the optical element 118 discussed above. The beveled surface results in a raised surface such that the optical element 118 is raised with respect to the surround grade or surface that the light fixture 900 is installed. The light fixture 900 is similarly configured as the light fixture 100. For the same or similar features, the same reference numbers will be used throughout the application herein. The faceplate 902 can comprise an optical element, such as but not limited to a lens or the like. The optical element can allow light emitted from the light source to pass substantially unaltered. However, in other aspects, the optical element can comprise light altering features to modify and/or alter the light emission of the light source. For example, the optical element can comprise refractive properties that spread or widen the emission pattern of the light source, while in other aspects, the optical element can comprise beam collimating features that concentrate the emission of the light source such that the emission pattern of the light source is narrowed. At least one advantage of the disclosure is that the light fixture 900 can accommodate various lighting requirements for various lighting applications. This allows the light fixture 900 to be used in many different lighting applications due to the light fixture 900 being customizable to meet various lighting application requirements.

Yet another advantage of the disclosure is that the heat sink assembly 400 can be used as a retrofit kit assembly for existing light fixtures. The heat sink assembly 400 installed in existing light fixtures provides improved heat dissipation, which in turns allows higher output light sources to be used in existing light fixtures. The heat sink assembly 400 allows existing light fixtures to be upgraded without having to remove the existing light fixture. Some existing light fixtures are installed in soil, concrete, asphalt and other hard surfaces that could require significant labor, time and expense to dig out and remove the existing light fixture. Installation of the heat sink assembly 400 in existing light fixtures would typically only require the removal of the faceplate and the existing light source. In some instances the existing electronic components that provided power to the existing light source could be used with the heat sink assembly 400.

The heat sink assembly can be configured in many different ways and is not intended to be limited to the aspects presented herein. For example, the heat sink assembly can comprise a plurality of heat pipes and a plurality of clamps, or each clamp can comprise a plurality of heat pipes. Furthermore, the heat sink assembly can be scaled up for larger fixtures using higher heat fluxes.

The previous description of the disclosure is provided to enable any person skilled in the art to make or use the disclosure. Various modifications to the disclosure will be readily apparent to those skilled in the art, and the generic principles defined herein may be applied to other variations without departing from the spirit or scope of the disclosure. Thus, the disclosure is not intended to be limited to the examples and designs described herein but is to be accorded the widest scope consistent with the principles and novel features disclosed herein.

I claim:

1. An in-grade lighting fixture, comprising:

a fixture housing comprising an optical chamber in said fixture housing, said optical chamber comprising:

at least one light source; and a heat sink assembly, wherein said at least one light source is in thermal communication with said heat sink and emits light out a top opening of said fixture housing;

wherein said heat sink assembly is in thermal communication with least one inner surface of said upper portion of said fixture housing establishing a thermal path between said at least one light source and said fixture housing;

wherein said heat sink assembly arranged to pivot within said optical chamber to adjust the direction of light emission from said at least one light source.

* * * * *